US009386660B1

(12) United States Patent
Sleator

(10) Patent No.: US 9,386,660 B1
(45) Date of Patent: Jul. 5, 2016

(54) LIGHT EMITTING DIODE MATCHING BY PHOTOVOLTAIC RESPONSE

(71) Applicant: Google Inc., Mountain View, CA (US)

(72) Inventor: Michael Sleator, Woodside, CA (US)

(73) Assignee: Google Inc., Mountain View, CA (US)

( * ) Notice: Subject to any disclaimer, the term of this patent is extended or adjusted under 35 U.S.C. 154(b) by 186 days.

(21) Appl. No.: 13/845,178

(22) Filed: Mar. 18, 2013

(51) Int. Cl.
*H05B 37/02* (2006.01)

(52) U.S. Cl.
CPC ..... *H05B 37/02* (2013.01)

(58) Field of Classification Search
CPC ..... H05B 37/02; H05B 37/0218; H05B 33/0845; H05B 33/0848; H05B 33/0854; H05B 33/0866
USPC ..... 315/149, 152, 291, 294, 297, 307, 312
See application file for complete search history.

(56) References Cited

U.S. PATENT DOCUMENTS

| | | | | |
|---|---|---|---|---|
| 7,329,998 | B2 | 2/2008 | Jungwirth | |
| 8,159,150 | B2 * | 4/2012 | Ashdown et al. | 315/307 |
| 2006/0000963 | A1 * | 1/2006 | Ng | G01J 3/10 250/205 |
| 2006/0125734 | A1 | 6/2006 | Cok et al. | |
| 2009/0101794 | A1 * | 4/2009 | Engstrand | 250/205 |
| 2010/0182294 | A1 | 7/2010 | Roshan et al. | |
| 2012/0063121 | A1 * | 3/2012 | Atkins | 362/97.1 |
| 2012/0213504 | A1 * | 8/2012 | Ollila et al. | 396/205 |
| 2013/0257287 | A1 | 10/2013 | Pi et al. | |

OTHER PUBLICATIONS

Li, et al., "Light emitting diode fault detection using pn junction photovoltaic effect", Review of Scientific Instruments 80, No. 5 (2009): 055108.

* cited by examiner

*Primary Examiner* — Thai Pham
(74) *Attorney, Agent, or Firm* — Morris & Kamlay LLP

(57) ABSTRACT

Disclosed is a method and device that may respond to the application of a uniform light source to a plurality of light emitting diodes. An electrical signal generated by each of the respective light emitting diodes in the plurality of light emitting diodes in response to the applied uniform light may be measured. The electrical signal may be measured by a sensing circuit. An adjusted drive signal generated based on a calibration value may be applied to each of the respective light emitting diodes.

24 Claims, 3 Drawing Sheets

300

LIGHT EMITTING DIODE MATCHING BY PHOTOVOLTAIC RESPONSE

BACKGROUND

Light emitting diodes (LEDs) have electrical characteristics that are related to emissive and absorptive properties of the LED. Individual multi-color LEDs are commonly formed from a combination or red, green and blue LEDs, that when the light output from each is combined may form different colors. The combined output of the red, green and blue LEDs is a white light. The individual red, green, and blue light emitting diodes commonly come from different batches from a manufacturer's vendor, and therefore have different electrical characteristics such as voltage and currents. Due to manufacturing differences in the red, green and blue LEDs, the white light generated by respective multi-color LEDs may have differences between one another that range very slight to drastic. This range of differences may not be noticeable in large displays containing thousands of LEDs or, even on an individual basis, but may be noticeable when a smaller number, such as hundreds, of LEDs is in a linear array or in a small area.

BRIEF SUMMARY

According to an implementation of the disclosed subject matter, a plurality of light emitting diodes may respond to an applied uniform light. A voltage generated by each of the respective light emitting diodes in the plurality of light emitting diodes in response to the applied uniform light may be measured. The voltage may be measured by a sensing circuit electrically coupled to the respective light emitting diode semiconductor chip. A memory device may store a calibration value related to the voltage generated by each of the respective light emitting diodes.

According to an implementation of the disclosed subject matter, a plurality of light emitting diodes may respond to the application of a uniform light. An electrical signal may be generated in response to the applied uniform light by each of the respective light emitting diodes in the plurality of light emitting diodes. The electrical signal may be measured by a sensing circuit electrically coupled to the respective light emitting diode semiconductor chip. A calibration value related to the electrical signal generated by each of the respective light emitting diodes of the plurality of light emitting diodes may be generated. In response to a drive signal for driving each of the respective light emitting diodes, an adjusted drive signal may be generated for each of the respective light emitting diodes using the drive signal and the generated calibration value. The adjusted drive signal may be applied to a drive circuit for each of the respective light emitting diodes at the respective light emitting diode.

According to an implementation of the disclosed subject matter, a device may include a microcontroller, a correction circuit, a light emitting diode driver, a light emitting diode, and an analog-to-digital converter. The microcontroller may include a processor and outputs for a drive signal and a correction function definition signal. The correction circuit may include inputs for receiving the drive signal and the correction function definition signal and an output for an adjusted drive signal. The light emitting diode driver circuit may include an input for receiving the adjusted drive signal, and the light emitting diode may be connected to the light emitting diode driver circuit. The analog-to-digital converter may have an input connected to the light emitting diode and an output connected to the microcontroller. When an external and uniform light source is applied to the light emitting diode, the analog-to-digital converter may receive an input signal from the light emitting diode.

Additional features, advantages, and implementations of the disclosed subject matter may be set forth or apparent from consideration of the following detailed description, drawings, and claims. Moreover, it is to be understood that both the foregoing summary and the following detailed description includes examples and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

The disclosed subject matter provides a method and system for calibrating a light emitting diode array. Calibration of a light emitting diode array according to an implementation 100 of the disclosed subject matter may leverage a characteristic of the light emitting diode. For example, the efficiency of a light emitting diode at turning electrons to photons may be directly equal to its ability to convert photons to electrons. In other words, a light emitting diode's emissive characteristics are substantially equal to its absorptive characteristics. By applying a uniform light to the array of light emitting diodes, each of the respective light emitting diodes is expected to produce an electrical signal, such as a voltage or current, equal to its emissive capability to produce a similar uniform light. By measuring the electrical signal and storing a value related to the electrical signal, a voltage or current based on the measured electrical signal may be applied to the light emitting diode to produce light that may be adjusted, or calibrated to produce a proper output of light.

Figure 1:
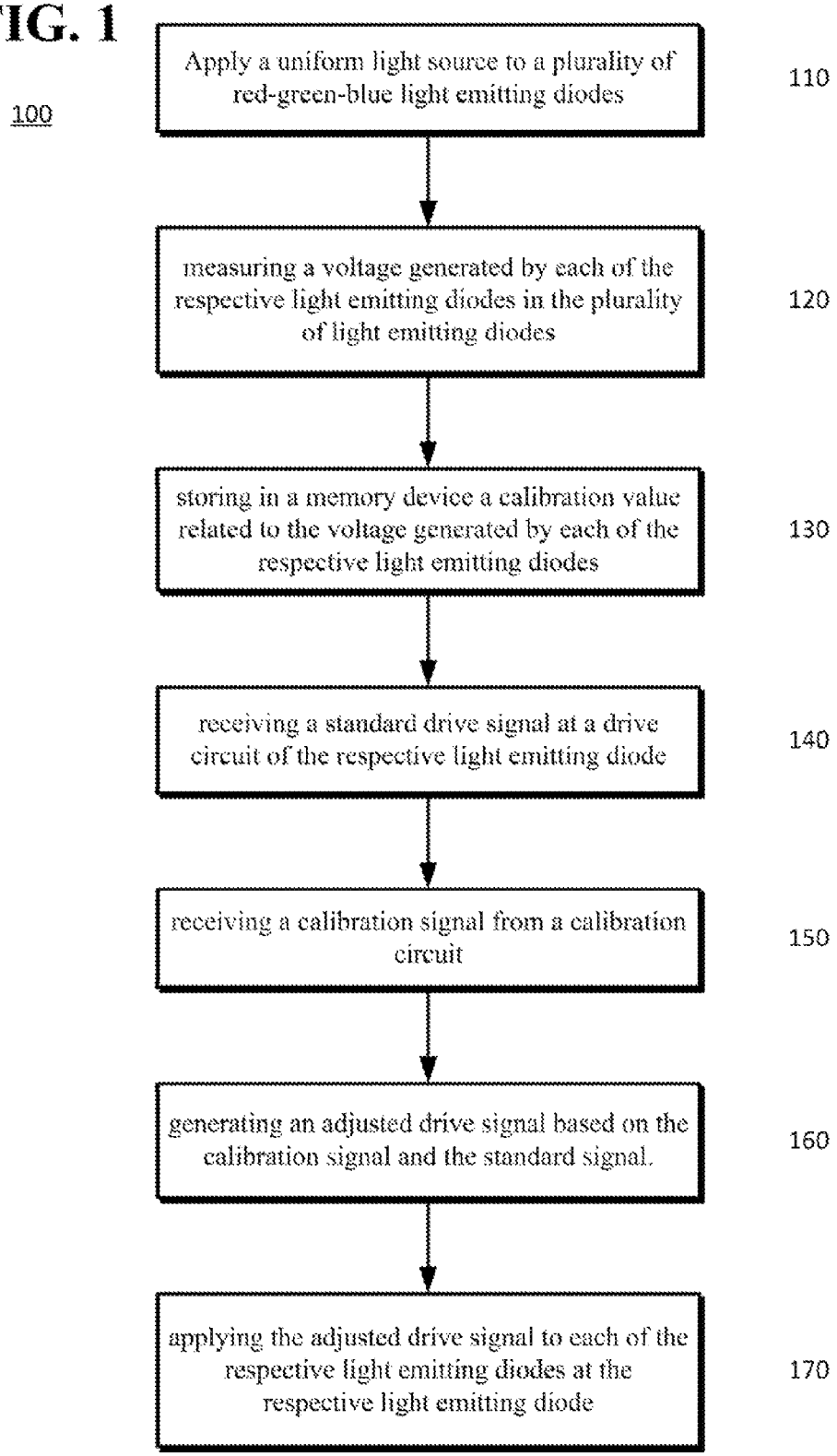
FIG. 1 shows a flowchart of a process according to an implementation of the disclosed subject matter.

FIG. 1 shows a flowchart of a process according to an implementation of the disclosed subject matter. The process 100 may be a process for calibrating an array of light emitting diodes, such as those on a light emitting diode image display device or an audio device that provide an indication of volume or signal intensity. For example, the array of light emitting diodes may be formed from a plurality of light emitting diodes that may be red-green-blue light emitting diodes. The red-green-blue light emitting diodes may consist of individual dice of red, green and blue light emitting diodes. To calibrate the array of light emitting diodes to produce a uniform output, a uniform light may be applied by an external and uniform light source to a plurality of light emitting diodes (step 110). The external and uniform light source may be in an enclosure that prevents the entry of ambient light and as such may be a light source separate and removed from the array of light emitting diodes. The external and uniform light source may also be a uniform white light source and may meet certain lighting standards. Each of the plurality of light emitting diodes may be located on a plurality of respective semiconductor chips. For example, red, green and blue dice may be incorporated into a single package to produce a red, green and blue light emitting diode component. In response to the applied uniform light, electrical signals, such as current, voltage or both may be generated by each of the respective light emitting diodes in the plurality of light emitting diodes. The respective light emitting diode chip may include a sensing circuit configured to measure the electrical signal, which may be either a voltage or current. At step 120, the electrical signal, such as a voltage, current or both, may be measured in response to the applied uniform light. The measured electrical signal may be converted to a digital value(s). The digital value may be called a calibration value. Each of the respective light emitting diodes of the plurality of light emitting diodes may generate an electrical signal that may be converted into an individual calibration value.

The individual calibration value may be stored in a memory device (Step 130). The memory device may be electrically coupled to the respective light emitting diode and may store one or more individual calibration values. The memory device may be a register. The register may be electrically coupled to the respective light emitting diode. For example, the register may be integrated with the drive circuitry of the respective light emitting diode. A standard drive signal may be generated by a controller for controlling the respective light emitting diodes. The standard drive signal may be generated based on the assumption that each of the light emitting diodes in the array has the same electrical characteristics. At step 140, the standard drive signal may be received at a drive circuit of the respective light emitting diode. Also received at the drive circuit of the respective light emitting diode may be a calibration signal from a calibration circuit (step 150). The calibration circuit may be a circuit on, or connected to, the light emitting diode chip that may convert the stored calibration value to the calibration signal. The calibration circuit may provide a respective calibration signal for specific light emitting diodes to each of the plurality of light emitting diode drive circuits. Based on the stored calibration signal and the standard signal, an adjusted drive signal may be generated (step 160) by each light emitting diode drive circuit. Each respective adjusted drive signal may be applied to each of the respective light emitting diodes. As a result, the adjusted drive signal may produce a uniform light output from each of the respective light emitting diodes.

The above described process may be practiced during the manufacturing process of a product incorporating the array of light emitting diodes. This process may only be applied at this time and never performed again. Alternatively, the process may be performed periodically, or at some later date, to keep the output of the array of light emitting diodes at its manufactured settings.

Figure 2:
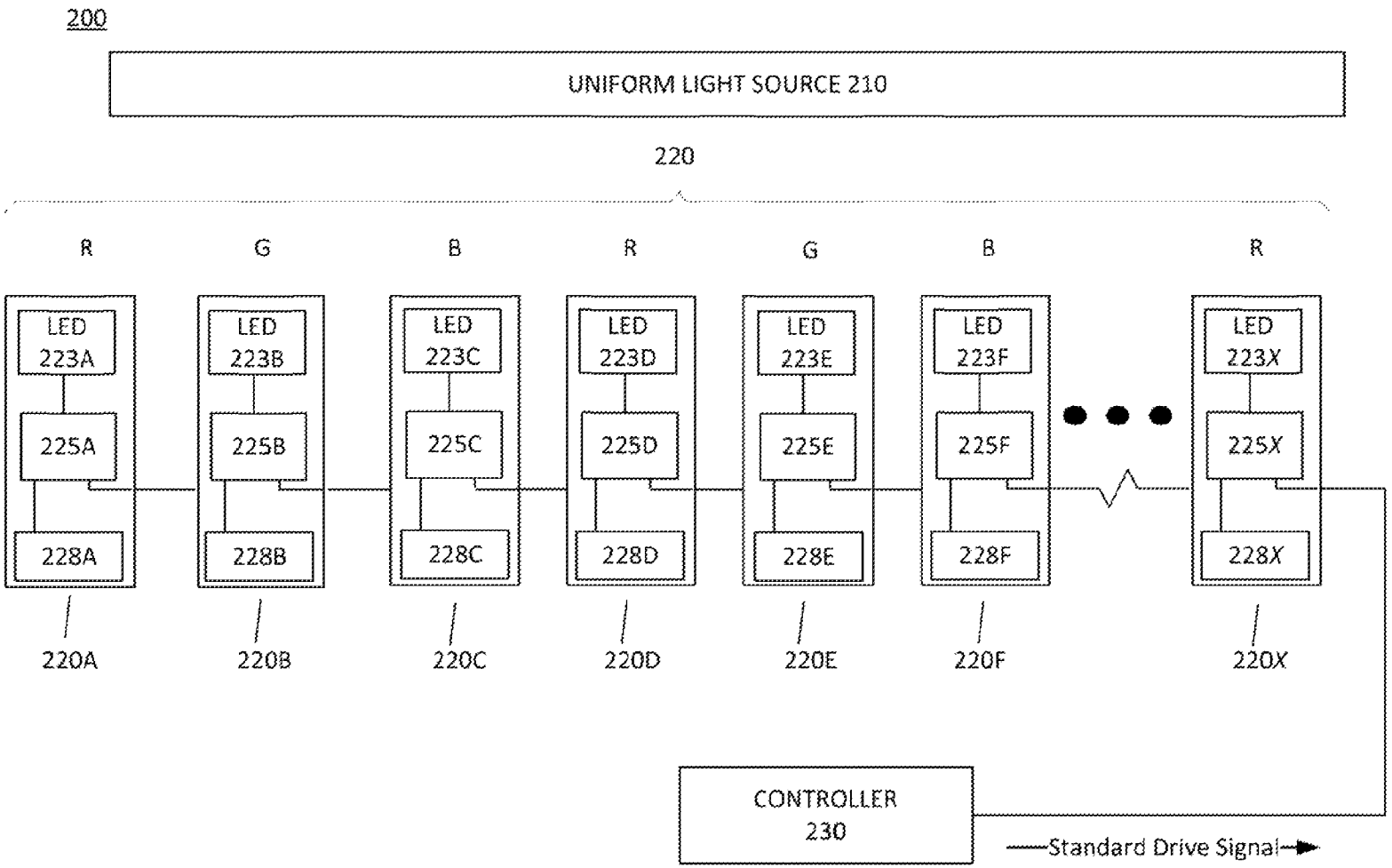
FIG. 2 shows a system component block diagram according to an implementation of the disclosed subject matter.

Various system configurations for implementing the above described process are envisioned. FIG. 2 shows a system component block diagram according to an implementation of the disclosed subject matter. The system 200 may be used to calibrate an array of light emitting diode packages 220 to produce a uniform light output. The system 200 may include a uniform light source 210 that may be enclosed in a housing (not shown) that prevents ambient light from entering during the calibration process. The system 200 may include a platform or jig (not shown) to hold the array of light emitting diode packages 220 in place when the uniform light is applied.

Each of the plurality of light emitting diode packages 220A-X may respectively include a light emitting diode 223A-X, a driving and sensing circuit 225A-X, a memory device 228A-X, signal input and signal output connections. In the example, the plurality of individual light emitting diodes 220A-X may be one of a red, green or blue light emitting diode 223A-X formed on individual die. As described above, the efficiency of each of the light emitting diodes 220A-X in turning electrons to photons may be directly equal to its ability to convert photons to electrons.

Each of the driving and sensing circuits 225A-X may also include circuitry for providing a driving function and a sensing function. The sensing circuit of the driving and sensing circuits 225A-X may be enabled prior to and/or during the calibration process. Once the calibration process is complete, the sensing circuit in each of the driving and sensing circuits 225A-X may be disabled. For example, a switch may enable and disable the sensing circuit of the driving and sensing circuits 225A-X in response a control input. The sensing circuit of the driving and sensing circuits 225A-X may have a variety of configurations. For example, it may include an enable/disable switch, analog-to-digital conversion circuitry, and other electrical components, such as transistors, resistors and capacitors. The respective sensing circuit will also include connections to the respective memory device 228A-X in each of the light emitting diodes 220A-X.

The driving circuit of each of the driving and sensing circuits 225A-X may include a correction circuitry and driving circuitry. The correction circuitry may store and apply a calibration value to a drive control signal to generate an adjusted drive signal. The driving circuitry may receive the adjusted drive signal and drive the respective LED in response. The driving circuit may include electrical components such as a digital-to-analog converter, operational amplifiers and other electrical components such as transistors, resistors and capacitors. Each of the respective driving circuits of the driving and sensing circuits 225A-X may include inputs for receiving signals from a controller 230 and from respective memory devices 228A-X.

The controller 230 may drive the array of light emitting diode packages 220 according to input signals from other components of a larger system into which the array of light emitting diode packages are incorporated. For example, the array of light emitting diode packages 220 may be incorporated into an audio control device. The array of light emitting diode packages 220 may indicate a volume level, or illuminate in rhythm to the audio signals, or may indicate a status of the device. For example, a red light may indicate the device is in a low-power state, while a green light may indicate that the device is ready to operate. The controller 230 may generate drive signals to cause the respective light emitting diodes 220A-X to generate light. The drive signal may be a standard drive signal that is intended to provide an expected output from the respective light emitting diodes 223A-X. The standard drive signal may be a current or voltage that when provided to the respective light emitting diode 223A-X will produce a light output of the expected intensity from a light emitting diode with expected electrical characteristics. However, each of respective light emitting diodes 223A-X may be different due to differences in manufacturing and fabrication, differences in the expected electrical characteristics of electrical components versus the actual electrical characteristics of the electrical components, and other differences. Accordingly, respective calibration signals may be used to match the light output of the respective light emitting diodes 223A-X to neighboring light emitting diodes of the same type.

Figure 3:
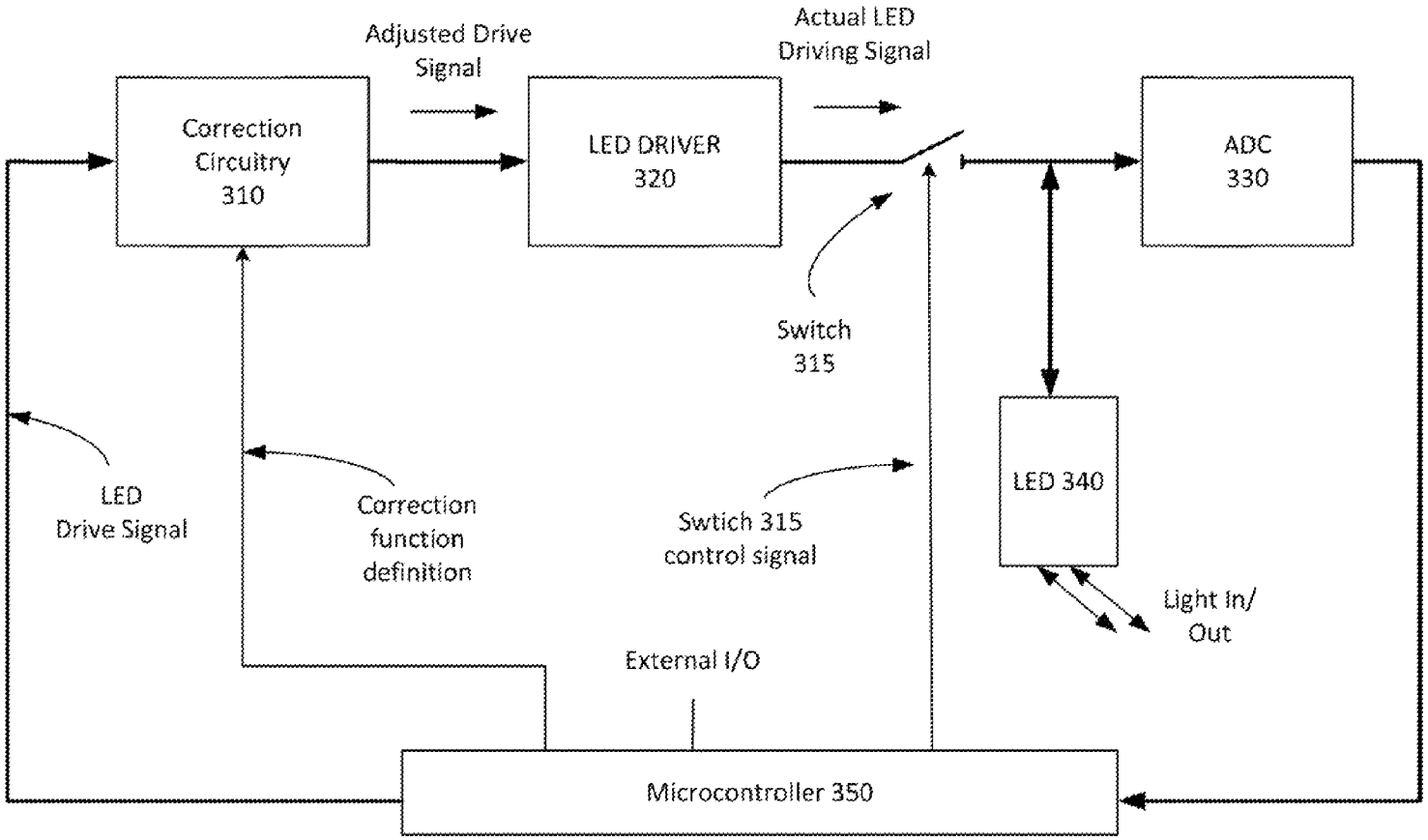
FIG. 3 shows a circuit block diagram of a light emitting diode according to an implementation of the disclosed subject matter.

FIG. 3 shows a configuration of a light emitting diode according to an implementation of the disclosed subject matter. For example, FIG. 3 illustrates a circuit block diagram of a respective one or more of light emitting diode packages 220A-X. The circuit 300 may include the respective light emitting diodes 223A-X, drive and sensing circuits 225A-X and the memory devices 228A-X. Alternatively, one or more of the components may be located remotely from the circuit 300.

The circuit 300 may include various components, such as correction circuitry 310, a light emitting diode (LED) driver 320, a calibration switch 315, an analog-to-digital converter (ADC) 330, an LED 340 and a microcontroller 350. The various components may be configured as shown in FIG. 3. The correction circuitry 310 may include a memory device, such as a register, that may be used to store data, such as a correction function definition. The calibration switch 315 may be a transistor or other similar switching device. The ADC 330 may be a known type of ADC, such as a direct conversion, a successive approximation, a ramp-compare, or the like. The microcontroller 350 may include a processor, and have inputs from external devices or other circuit components. The microcontroller 350 may have signal and control outputs to, for example, the correction circuitry 310 and the calibration switch 315. The microcontroller 350 may output an LED drive signal, or standard drive signal, based on, or in response to, an input (not shown) to the microcontroller 350.

During LED calibration, the calibration switch 315 may be opened, which may disconnect LED Driver 320 from the LED 340 and ADC 330. A uniform reference light may illuminate LED 340. The ADC 340 may measure the photovoltaic output (PV), either a voltage or a current, of the LED 340 in response to the applied uniform reference light and generate a digital PV value. The microcontroller 350 may compare the measured PV value(s) with a reference PV value(s). The reference PV values may be stored and memory or provided by an external device, such as a computer network. Based on the results of the comparison, the microcontroller 350 may compute a correction function definition. The correction function definition may be provided to the correction circuitry 310. The correction function definition may be a single calibration value, or series of calibration values, related to different components settings, such as, for example, resistance values or capacitance values within the correction circuitry 310. Alternatively, the correction function definition may be a single value such as a calibration value to offset the drive signal output by the microcontroller 350. The correction function definition may be loaded into and/or stored in the correction circuitry 310, and the calibration switch 315 may be closed to exit calibration mode.

The above calibration steps may be repeated a number of times to collect multiple calibration points. The measured PV value or values may be used to determine the relationship between a particular LED device and a predictive model of the general class of LED devices. For example, a predictive model may predict photoemissive characteristics of the device, for example, the optical power out compared to electrical current in, on the basis of the photoelectric characteristics, such as the electrical current (or voltage) out versus the optical power in. Such a predictive model may be based on measurements of a population of devices, or it may be a theoretical model based on the physics of the device. The differences between the measured PV values and a reference set of values in the predictive model may be used to compute the correction function (f(x)) definition, which is then loaded into the correction circuitry 310. In the general case, the photovoltaic-photoemissive relationship may be a predictable arbitrary non-linear function. For example, the photoemissive characteristic of a light-emitting diode may be logarithmically related to the photovoltaic characteristic. The photovoltaic-photoemissive relationship may be predicted with sufficient accuracy to utilize the disclosed implementations.

When outputting light, the calibration switch 315 may be closed, connecting the LED 340 to the LED driver 320. Generally, the ADC 330 may have a high input impedance, and, as a result of the high impedance, the ADC may be left connected at all times. Of course, it could also be disconnected after the calibration operation is complete. The microcontroller 350 may request a specific output from the LED 340, and may output a drive signal to the correction circuitry 310. The drive signal may be modified by the correction circuitry 310. The correction circuitry 310 may generate and output an adjusted, or corrected, drive signal to the LED driver 320. In response to the adjusted drive signal, the LED driver 320 may generate the LED driving signal that drives the output of the LED 340 to the specific output. The LED driving signal may be a pulse width modulated (PWM) signal with a constant current value or may be a constantly supplied current drive signal with a variable current value. The correction circuitry 310 may ensure that the actual optical output matches the requested output by compensating for fabrication deficiencies, disparity in electrical component tolerances, and the like. In this way multiple LEDs, such as LEDs 220A-X, each with their own correction circuitry 310, may be given the same drive signal value from the microcontroller 350 or a separate microcontroller, and the actual optical output power from the respective LEDs will match because of the drive signal adjustments made by the correction circuitry 310.

In an implementation, the correction circuitry 310, LED driver 320, and ADC 330 may be incorporated into a single integrated circuit. For improved economy, a single integrated circuit may contain several such functional blocks and may thereby control several LEDs. In which case, it may be desirable to employ only a single ADC, using an analog multiplexer or other switching arrangement to connect one LED at a time to the ADC. A number, such as tens to tens of thousands, of LEDs may be arranged in a physically contiguous array. The calibration operation may be performed on the entire array by exposing the entire array to a uniform reference illumination and performing the above calibration sequence for each LED. In the case of an array incorporating LEDs of different types (e.g., an RGB color array), it may be desirable to calibrate all LEDs of one type with one uniform reference illuminant, such as red, green or blue light, and those of a different type with a different illuminant depending, for example, on the circumstances of a manufacturing operation. For example, in the case of an RGB array, a uniform white light may be applied to calibrate all of the LEDs, or a uniform red light may be used to calibrate the red LEDs, a uniform green light may be used to calibrate the green LEDs, and a uniform blue light might be used to calibrate the blue LEDs.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A method comprising:

directly exposing a plurality of light emitting diodes to incident uniform light from a light source that is external to the plurality of light emitting diodes;

measuring, at a respective light emitting diode of the plurality of light emitting diodes and while directly exposing the plurality of light emitting diodes to the incident uniform light, an electrical signal generated by the incident uniform light, wherein the measured electrical signal is measured by a sensing circuit electrically coupled to the respective light emitting diode;

determining a calibration value for the respective light emitting diode based on the measured electrical signal; and storing the calibration value in a memory device.

2. The method of claim 1, further comprising:

applying an adjusted drive signal to the respective light emitting diode, wherein the adjusted drive signal is based on the calibration value.

3. The method of claim 1, wherein the plurality of light emitting diodes is located on a chip.

4. The method of claim 3, wherein the external and uniform light source is a uniform white light source.

5. The method of claim 1, wherein the measured electrical signal is a voltage, a current or both.

6. The method of claim 1, further comprising:

converting the measured electrical signal to a digital value.

7. The method of claim 1, wherein the plurality of light emitting diodes are red-green-blue light emitting diodes consisting of individual red, green and blue light emitting diodes.

8. The method of claim 1, wherein the light source is in an enclosure that prevents the entry of ambient light.

9. The method of claim 1, wherein the memory device is remote from the respective light emitting diode.

10. The method of claim 1, wherein the memory device is integrated into the respective light emitting diode.

11. The method of claim 1, wherein the sensing circuit is an analog-to-digital converter.

12. The method of claim 1, wherein the memory device is integrated with drive circuitry and coupled to the respective light emitting diode.

13. The method of claim 1, further comprising:

receiving a standard drive signal at a drive circuit of the respective light emitting diode;

receiving a calibration signal from a calibration circuit; and generating from the standard drive signal, an adjusted drive signal based on the calibration signal.

14. The method of claim 1, wherein the memory device is located on a chip having the respective light emitting diode.

15. A method comprising:

directly exposing a plurality of light emitting diodes to incident uniform light from a light source that is external to the plurality of light emitting diodes;

measuring, at a respective light emitting diode of the plurality of light emitting diodes and while directly exposing the plurality of light emitting diodes to the incident uniform light, an electrical signal generated by the incident uniform light, wherein the measured electrical signal is measured by a sensing circuit electrically coupled to the respective light emitting diode;

determining a calibration value for the respective light emitting diode based on the measured electrical signal;

responsive to a drive signal for driving the respective light emitting diode, generating an adjusted drive signal for the respective light emitting diode using the drive signal and the calibration value; and applying the adjusted drive signal to a drive circuit coupled to the respective light emitting diode.

16. The method of claim 15, wherein the measured electrical signal is a voltage, a current or both.

17. The method of claim 15, further comprising:

converting the measured electrical signal to a digital value.

18. The method of claim 15, wherein the plurality of light emitting diodes are red-green-blue light emitting diodes consisting of individual red, green and blue light emitting diodes.

19. The method of claim 15, wherein the light source is in an enclosure that prevents an entry of ambient light.

20. The method of claim 15, further comprising: storing the calibration value in a memory device.

21. The method of claim 20, wherein the memory device is a remote memory device.

22. The method of claim 15, wherein the light source is a uniform white light source.

23. A method comprising:

disconnecting a plurality of light emitting diodes housed in a device from a drive signal, wherein disconnecting the drive signal causes the plurality of light emitting diodes to stop emitting light;

directly exposing the plurality of light emitting diodes to incident uniform light from a light source that is external to the device;

measuring, at a first light emitting diode of the plurality of light emitting diodes and while directly exposing the plurality of light emitting diodes to the incident uniform light, a first electrical signal generated by the incident uniform light, wherein the first electrical signal is measured by a sensing circuit housed in the device and electrically coupled to the first light emitting diode;

determining a first calibration value for the first light emitting diode based on the first electrical signal; and storing the first calibration value in a memory device.

24. The method of claim 23, further comprising:

measuring, at a second light emitting diode of the plurality of light emitting diodes and while directly exposing the plurality of light emitting diodes to the incident uniform light, a second electrical signal generated by the incident uniform light, wherein the second electrical signal is different from the first electrical signal;

determining a second calibration value for the second light emitting diode based on the second electrical signal, wherein determining the second calibration value is based on a comparison of the second electrical signal to a reference value;

storing the second calibration value in the memory device;

connecting the plurality of light emitting diodes to the drive signal;

generating, by one or more correction circuits housed in the device, a first corrected drive signal based on the first calibration value and a second corrected drive signal based on the second calibration value; and providing the first corrected drive signal to the first light emitting diode and the second corrected drive signal to the second light emitting diode.

* * * * *